US011318590B2

(12) United States Patent
Gaines et al.

(10) Patent No.: US 11,318,590 B2
(45) Date of Patent: May 3, 2022

(54) TOOL EXTENSION

(71) Applicant: Snap-on Incorporated, Kenosha, WI (US)

(72) Inventors: Preston T. Gaines, Racine, WI (US); Jonathan I. Andersen, Racine, WI (US)

(73) Assignee: Snap-on Incorporated, Kenosha, WI (US)

( * ) Notice: Subject to any disclaimer, the term of this patent is extended or adjusted under 35 U.S.C. 154(b) by 307 days.

(21) Appl. No.: 16/514,252

(22) Filed: Jul. 17, 2019

(65) Prior Publication Data

US 2021/0016421 A1 Jan. 21, 2021

(51) Int. Cl.

| | |
|---|---|
| ***B25B 23/00*** | (2006.01) |
| ***B25B 13/48*** | (2006.01) |
| ***B25B 13/46*** | (2006.01) |
| ***B25B 15/00*** | (2006.01) |

(52) U.S. Cl.
CPC ..... *B25B 23/0007* (2013.01); *B25B 13/481* (2013.01); *B25B 13/46* (2013.01); *B25B 15/008* (2013.01)

(58) Field of Classification Search
CPC ..... B25B 13/48; B25B 13/06; B25B 15/008; B25B 23/0007
See application file for complete search history.

(56) References Cited

U.S. PATENT DOCUMENTS

| | | | | |
|---|---|---|---|---|
| D142,054 | S * | 8/1945 | Young | D8/29 |
| 4,344,340 | A | 8/1982 | Erickson | |
| 4,982,632 | A * | 1/1991 | Barmore | B25B 13/06 279/83 |
| D318,997 | S * | 8/1991 | Baker | D8/29 |
| D319,562 | S * | 9/1991 | Ballard | D8/29 |
| 5,343,786 | A * | 9/1994 | Wridt | B25B 15/001 279/9.1 |
| 5,485,769 | A * | 1/1996 | Olson | B25B 15/001 81/177.85 |
| 5,868,048 | A * | 2/1999 | Cassutti | B25B 15/02 81/439 |
| 6,038,946 | A | 3/2000 | Jackson et al. | |
| 6,269,717 | B1 | 8/2001 | Bollinger | |

(Continued)

FOREIGN PATENT DOCUMENTS

| | | |
|---|---|---|
| DE | 19535485 | 3/1997 |
| EP | 1878524 A2 | 1/2008 |

(Continued)

OTHER PUBLICATIONS

Genius Tools USA tool catalogue, 594 pages, https://www.geniustoolsusa.com/media/catalogue/GT-19_LoRes.pdf (Year: 2021).*

(Continued)

*Primary Examiner* — David B. Thomas
(74) *Attorney, Agent, or Firm* — Seyfarth Shaw LLP

(57) ABSTRACT

A tool extension adapted to couple to a drive lug of a driver and a tool that allows the tool to reach hard to reach places without room for a coupling. The tool extension voids the need for a larger diameter coupling by including a female recess in an end of the tool extension that receives the bit into the shaft itself.

12 Claims, 6 Drawing Sheets

(56) References Cited

U.S. PATENT DOCUMENTS

| | | | | |
|---|---|---|---|---|
| 6,715,384 | B1 * | 4/2004 | Kozak | B25B 13/06 81/124.2 |
| 6,748,828 | B2 | 6/2004 | Bollinger | |
| D493,081 | S | 7/2004 | Chen | |
| 6,901,825 | B1 * | 6/2005 | Lebron | B25B 13/5091 81/124.2 |
| 6,976,411 | B1 | 12/2005 | Yu | |
| 7,077,037 | B2 * | 7/2006 | Shevela | B25B 13/06 81/121.1 |
| 7,114,418 | B1 * | 10/2006 | Allen | B25B 13/48 81/439 |
| 7,131,358 | B2 * | 11/2006 | Hsien | B25B 23/0035 81/438 |
| 7,194,935 | B1 | 3/2007 | Li | |
| 7,340,984 | B2 * | 3/2008 | Hsieh | B25B 13/06 81/125.1 |
| D582,242 | S * | 12/2008 | Bryan | D8/107 |
| D584,118 | S | 1/2009 | Halstead | |
| 8,065,938 | B1 | 11/2011 | Kravitch | |
| 8,205,529 | B1 | 6/2012 | Laurie | |
| D669,753 | S | 10/2012 | Stinson | |
| 8,733,215 | B1 | 5/2014 | Kravitch | |
| 9,144,893 | B2 * | 9/2015 | Su | B25B 13/56 |
| D761,068 | S * | 7/2016 | Brown | D8/29 |
| 9,827,654 | B2 * | 11/2017 | Su | B25B 13/56 |
| 9,844,862 | B1 * | 12/2017 | Velez | B25B 23/12 |
| 10,427,278 | B2 * | 10/2019 | Su | B25B 23/0035 |
| 2002/0178874 | A1 * | 12/2002 | Lee | B25B 15/02 81/177.2 |
| 2004/0074344 | A1 | 4/2004 | Carroll | |
| 2004/0163501 | A1 | 8/2004 | Chen | |
| 2005/0160882 | A1 | 7/2005 | Crow | |
| 2006/0175773 | A1 * | 8/2006 | Tsai | B25B 23/12 279/143 |
| 2007/0256526 | A1 * | 11/2007 | Razzaghi | B66F 3/12 81/176.15 |
| 2011/0048175 | A1 * | 3/2011 | LeVert | B25B 13/48 81/54 |
| 2012/0204685 | A1 | 8/2012 | Marson | |
| 2013/0068072 | A1 | 3/2013 | Li et al. | |
| 2018/0104807 | A1 * | 4/2018 | Ma | B25B 15/008 |
| 2018/0125559 | A1 | 5/2018 | Ortiz et al. | |
| 2021/0197345 | A1 * | 7/2021 | LeVert | B25B 13/06 |

FOREIGN PATENT DOCUMENTS

| | | | |
|---|---|---|---|
| EP | 2837468 | A2 | 2/2015 |
| GB | 2155831 | A | 10/1985 |
| TW | 201834792 | A | 10/2018 |

OTHER PUBLICATIONS

United Kingdom Combined Search and Examination Report for Application No. GB2001748.9 dated Jun. 8, 2020, 8 pages.

Australian Examination Report for Application No. 2020200667 dated Nov. 17, 2020, 7 pages.

Taiwan Office Action for corresponding Taiwan Application No. 109113817 dated Apr. 6, 2021, 7 pages.

Canadian Office Action for corresponding Canadian Application No. 3,076,049 dated Apr. 19, 2021, 3 pages.

United Kingdom Office Action for corresponding Application No. GB2001748.9 dated Sep. 3, 2021, 5 pages.

Canadian Office Action for corresponding CA Application No. 3,076,049, dated Oct. 29, 2021, 3 pages.

Examination Report No. 2 for corresponding Application No. 2020200667 dated Oct. 8, 2021, 5 pages.

Examination Report No. 3 for corresponding Application No. 2020200667 dated Nov. 16, 2021, 5 pages.

* cited by examiner

TOOL EXTENSION

TECHNICAL FIELD OF THE INVENTION

The present invention relates generally to tools. More particularly, the present invention relates to tool extensions.

BACKGROUND OF THE INVENTION

Tools, for example bit drivers, are often used in hard to reach places. In order to allow access to hard to reach places, an extension is typically coupled to the tool using a coupling, such as a removable socket. The coupling has a diameter that is substantially larger than the tool. This solution is not effective in applications that require a tool to have an extension to reach, for example, a fastener but the space surrounding the fastener cannot accommodate the large diameter of the coupling that couples the tool and extension. Accordingly, disassembly of components surrounding the fastener is required to create space to access the fastener,

SUMMARY OF THE INVENTION

The present invention broadly relates to a tool extension adapted to couple to a drive and a tool.

In an embodiment, the present invention broadly comprises a tool extension having an elongated shank with first and second ends. A first recess is formed in the first end and is adapted to receive a tool. A second recess is formed in the second end and is adapted to receive a drive lug of a driver. In another embodiment, a tool bit is formed at the first end.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
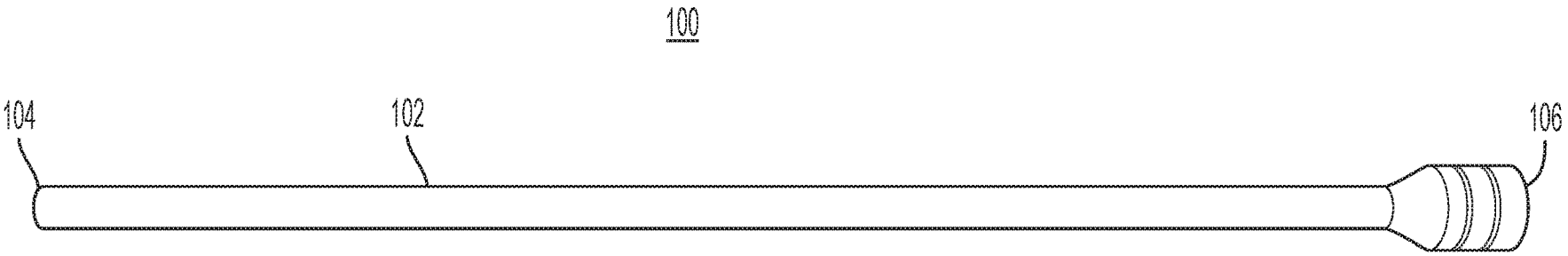
FIG. 1 is a side plan view of an embodiment of a tool extension of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises a tool extension adapted to couple to a drive and a tool. Such extension can be beneficial for, as an example, allowing the tool to reach hard to reach places without room for a conventional coupling. In an embodiment, the tool extension avoids the larger diameter coupling of prior art devices and bit drivers that typically require two pieces connected at a larger diameter coupling, by machining or forming a female recess that matingly receives the tool into the shaft itself.

Figure 2:
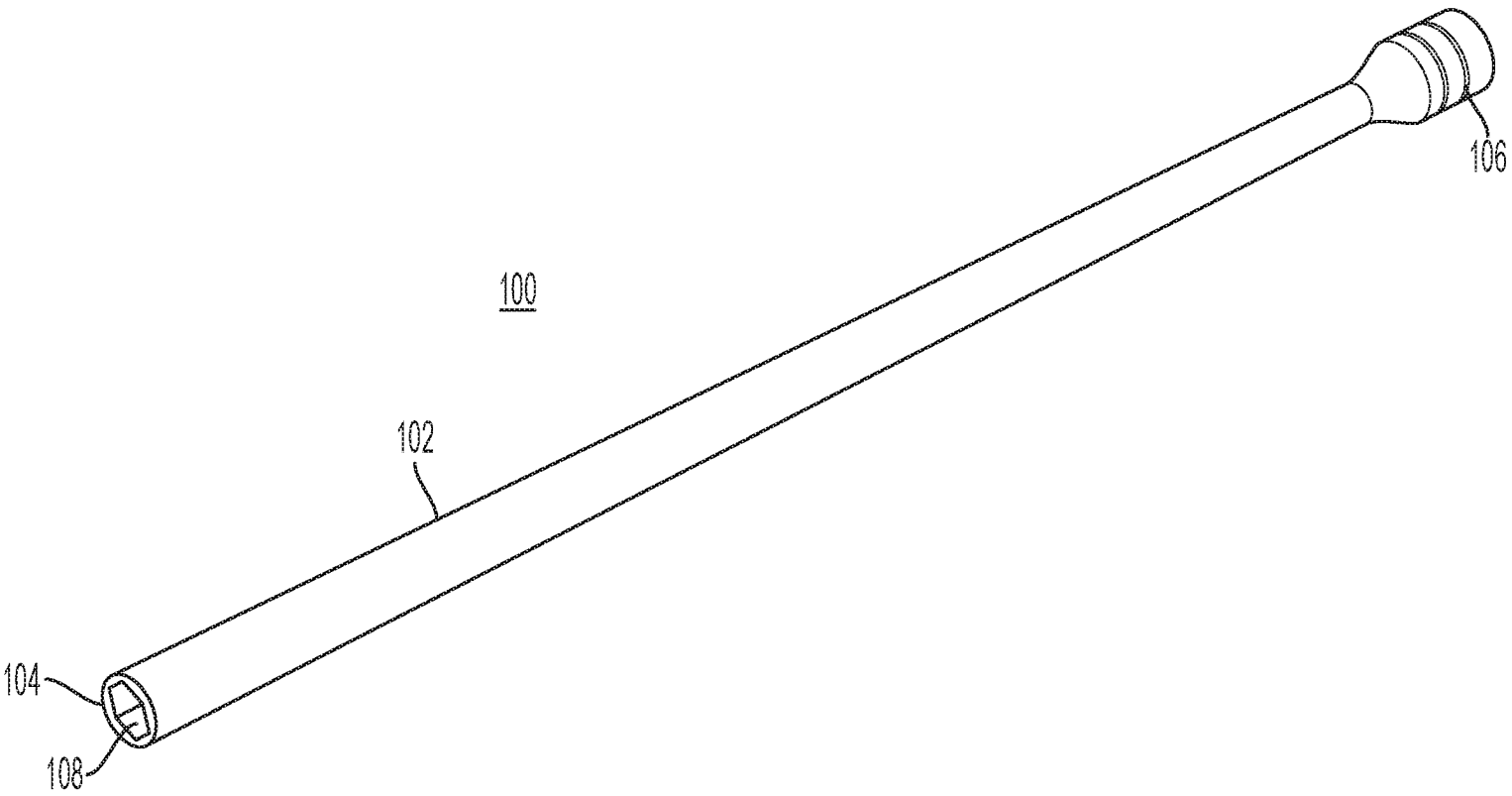
FIG. 2 is a perspective side view of the tool extension of FIG. 1.
Figure 3:
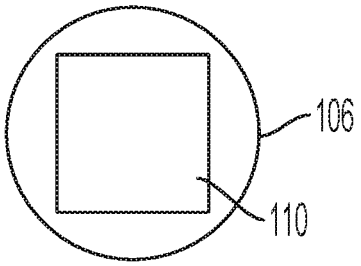
FIG. 3 is a plan view of a second end of the tool extension of FIG. 1.
Figure 4:
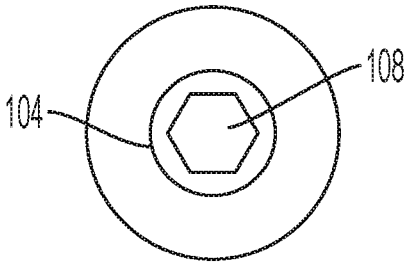
FIG. 4 is a plan view of a first end of the tool extension of FIG. 1.
Figure 5:
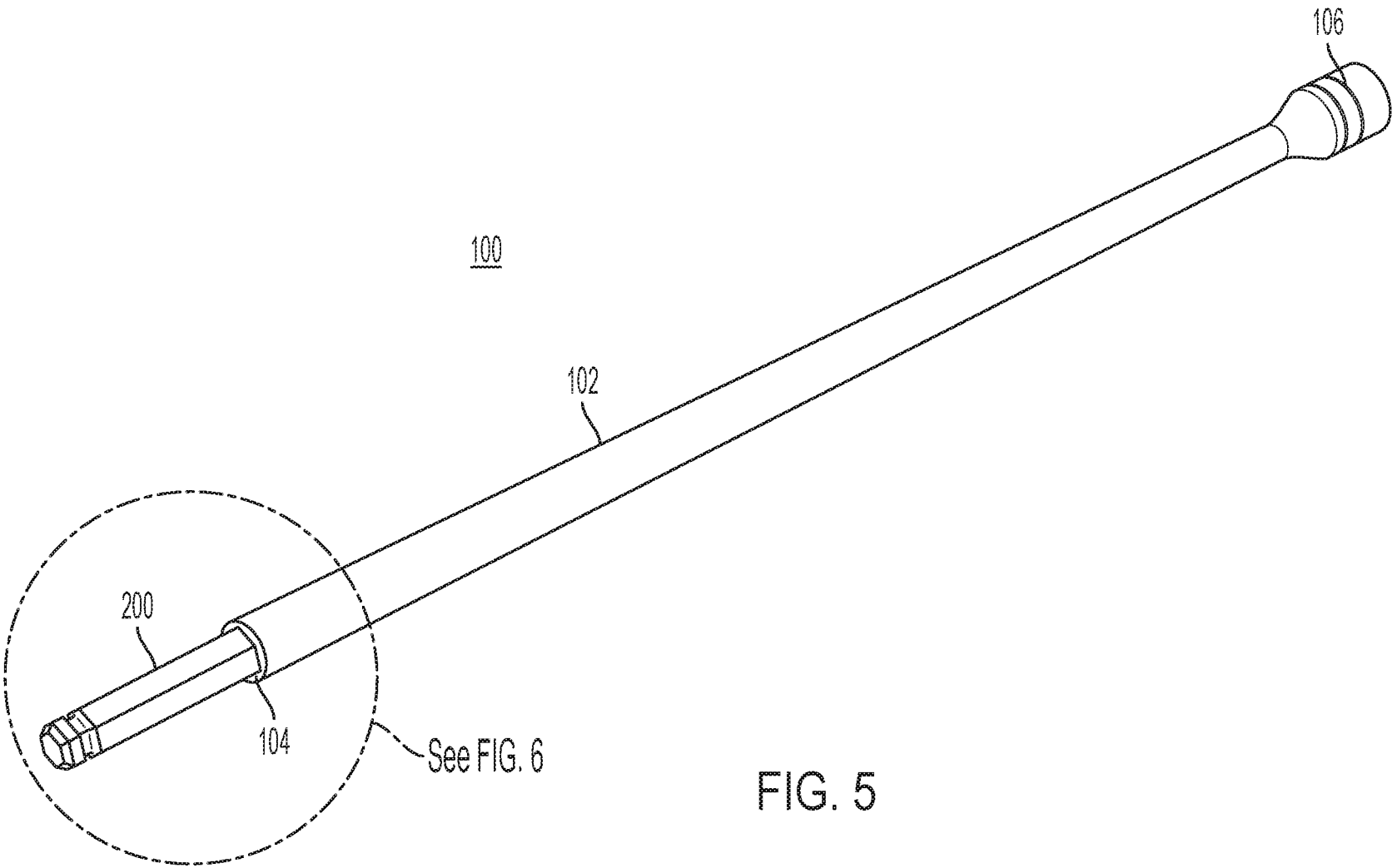
FIG. 5 is a perspective side view of the tool extension of FIG. 1 coupled to a tool.
Figure 6:
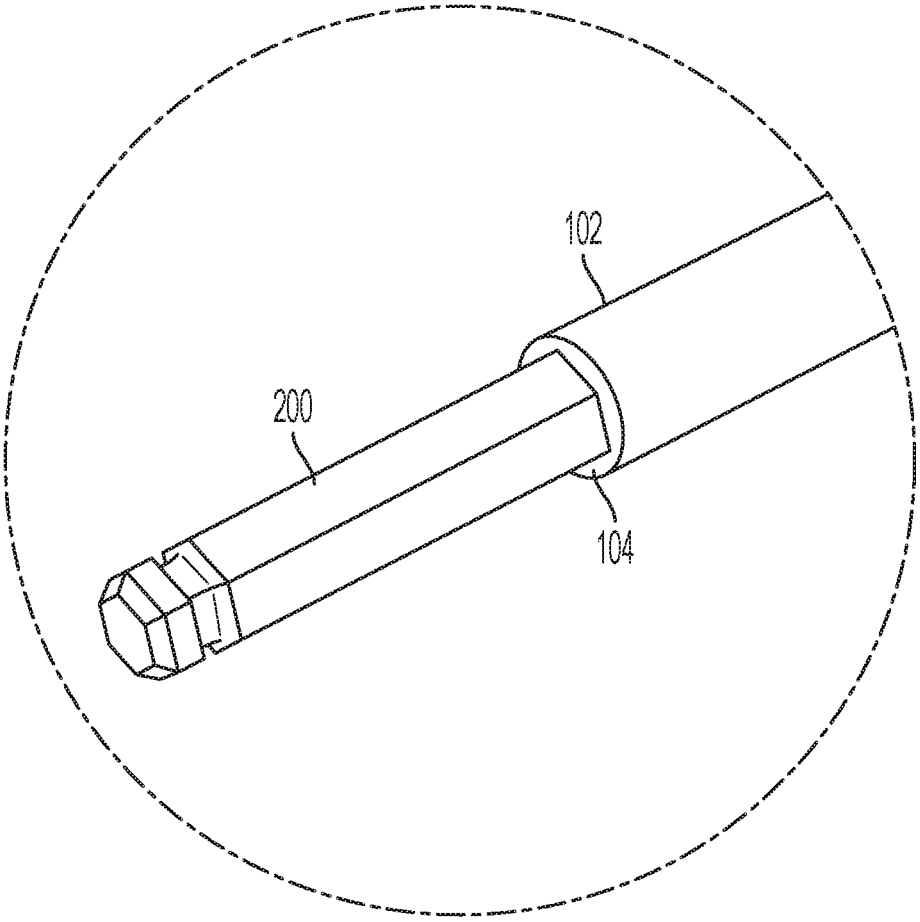
FIG. 6 is a perspective, enlarged detail view of the tool extension coupled to a tool shown in FIG. 5
Figure 7:
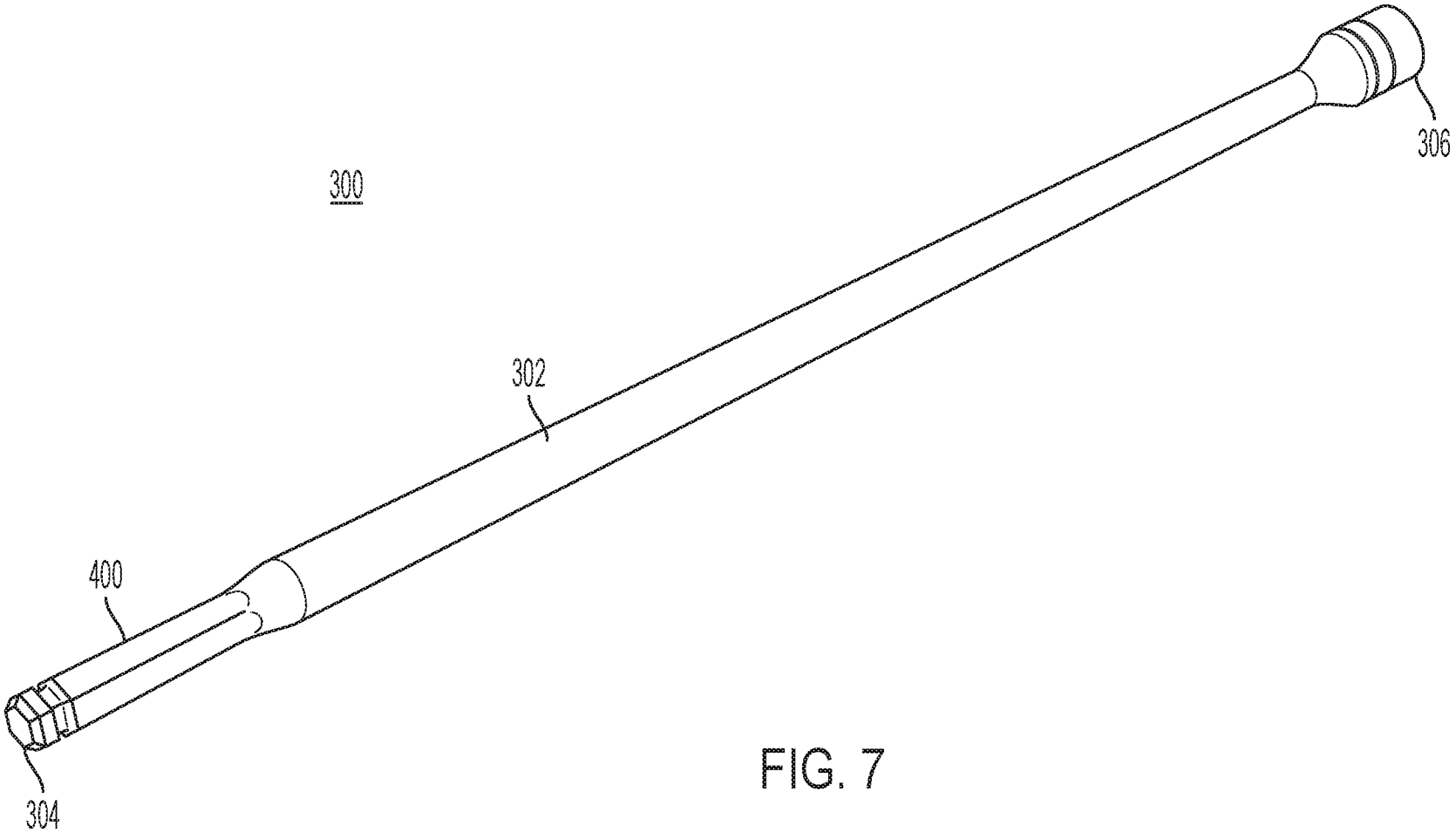
FIG. 7 is a perspective side view of another embodiment of a tool extension of the present invention.

Referring to FIGS. 1 through 6, an embodiment of a tool extension 100 of the present invention is shown. The tool extension 100 of the present invention may be adapted to couple to a tool 200 and a drive lug of a driver, for example a ratchet, torque wrench, drill or impact tool (not shown). As illustrated, the tool 100 includes a shank 102, a first end 104 and an opposing second end 106. A first recess 108 may be disposed at the first end 104, and a second recess 110 may be disposed at the second end 106.

The shank 102 may be elongated, having any desired length, and may be of hollow or solid construction. Although illustrated as having a circular cross-section, the shank 102 may have other cross-sections, such as rectangular, square, elliptical, etc. The shank 102 may have the same cross-sectional size as the first end 104, which may be smaller than the cross-sectional size of the second end 106. Alternately, the shank 102 may have a cross-section that is the same size as the second end 106 and larger than the cross-section of the first end 104.

In an embodiment, the first recess 108 is machined or otherwise integrally formed in the first end 104 and is adapted to matingly engage the tool 200. As illustrated, the cross section of the first recess 108 can be hexagonal and adapted to matingly engage a hexagonal end of tool 200. Alternately, other cross-sections may be used, such as square, rectangular, etc., in order to matingly engage tools with corresponding cross-sections.

In an embodiment, the tool 200 can be a bit driver. As illustrated, the tool 200 can be a hexagonal bit driver, although, as described above, the tool 200 can have various suitable cross-sections, such as square, rectangular, etc. for transferring torque from the driver to a mating recess on top of a helically-threaded fastener. In other embodiments, the tool 200 can be a tool bit that includes a socket for receiving and engaging a head of a fastener, or a tool bit with a Philips, flat, Torx, or other suitable drive head for engaging a head of a fastener, etc.

In an embodiment, the second recess 110 is machined or otherwise integrally formed in the second end 106 and is adapted to matingly engage a drive lug of a driver (not shown). The second end 106 may also have a diameter larger than a diameter of the first end 104. As illustrated, the opening of the second recess 110 can be square and adapted to receive a square drive lug. Alternately, other openings may be used such as hexagonal, rectangular, etc., in order to matingly receive drive lugs with corresponding cross-sections.

In another embodiment, a tool extension 300 can be an integrated component with the tool 400. In this embodiment, the tool extension 300 is the same as described above except the tool 400 is formed as part of the shank 302 at a first end 304. Similar to above, the second end 306 is adapted to receive a drive lug of a driver (not shown). The tool 400 can be a hexagonal bit driver, although, the tool 400 can have various suitable cross-sections, such as square, rectangular, etc. for transferring torque from the driver to a mating recess on top of a helically-threaded fastener. In other embodiments, the tool 400 can be a tool bit that includes a socket for receiving and engaging a head of a fastener, a tool bit with a Philips, flat, Torx, or other suitable drive head for engaging a head of a fastener, etc.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A tool extension for a tool and that is adapted to be coupled to a drive lug of a driver, the tool extension comprising:

an elongated shank having opposing first and second ends respectively having first and second end cross-section sizes, wherein the second end cross section size is larger than the first end cross section size;

a first recess formed in the first end and adapted to matingly engage the tool; and a second recess formed in the second end and adapted to matingly engage the drive lug, wherein at least a portion of the shank between the first and second ends has a shank cross-section size that is the same as the first end cross-section size and is of solid construction.

2. The tool extension of claim 1, wherein the shank has a round cross-section.

3. The tool extension of claim 1, wherein the first recess has a hexagonal cross-sectional shape.

4. The tool extension of claim 1, wherein the second recess has a square cross-sectional shape.

5. A tool extension comprising:

an elongated shank having opposing first and second ends;

a first recess formed in the first end and adapted to matingly engage a tool bit; and a recess formed in the second end and adapted to receive a drive lug of a driver, wherein at least a portion of the shank between the first and second ends is of solid construction.

6. The tool extension of claim 5, wherein the shank has a round cross-section.

7. The tool extension of claim 5, wherein a cross-section of the second end is larger than a cross-section of the portion of the elongated shank between the first and second ends.

8. The tool extension of claim 7, wherein a cross-section of the second end is larger than the cross-section of the first end.

9. The tool extension of claim 5, wherein a cross-section of the tool bit is hexagonal.

10. The tool extension of claim 5, wherein the recess has a square cross-sectional shape.

11. The tool extension of claim 5, wherein the tool bit is a bit driver.

12. The tool extension of claim 5, wherein the driver is a ratchet wrench, a drill, or an impact driver.

* * * * *